United States Patent [19]

Schurman

[11] 4,381,059

[45] Apr. 26, 1983

[54] PUZZLE-LOCKING CONTAINER AND METHOD FOR STORING AND DISPENSING ARTICLES

[75] Inventor: Edwin A. Schurman, Arlington, Tex.

[73] Assignee: Charles E. Schurman, Fort Worth, Tex.

[21] Appl. No.: 89,765

[22] Filed: Oct. 31, 1979

[51] Int. Cl.[3] ..... B65D 83/04

[52] U.S. Cl. ..... 206/533; 206/534; 206/1.5; 220/346; 221/91; 116/308

[58] Field of Search ..... 206/533, 534, 534.2, 206/536, 538, 459, 229, 214, 1.5, 267, 276; 116/308, 309, 311, 324; 221/91, 103, 132; 220/345, 346; 215/204, 205

[56] References Cited

U.S. PATENT DOCUMENTS

| | | | |
|---|---|---|---|
| 601,568 | 3/1898 | Jacoby | 220/346 |
| 827,539 | 7/1906 | Kahlmeyer | 206/214 |
| 918,519 | 4/1909 | Eberhart | 206/267 |
| 1,535,755 | 4/1925 | Acosta | 220/345 |
| 1,718,400 | 6/1929 | Baarsgard | 220/345 |
| 2,506,600 | 5/1950 | Kassovic | 206/267 |
| 3,057,464 | 10/1962 | Baggott | 206/536 |
| 3,095,085 | 6/1963 | Meijer | 206/536 |
| 3,162,301 | 12/1964 | Cage | 206/534 |
| 4,204,611 | 5/1980 | Graves | 206/538 |

*Primary Examiner*—Herbert F. Ross

*Attorney, Agent, or Firm*—Charles E. Schurman

[57] ABSTRACT

Easy opening article storing and dispensing containers and method in which puzzle-like locking means secure against access to the container contents by very young children by obscuring the mode of opening it. The cannular container shell has closable dispensing aperture means opening through the shell side wall. Locking means at one or more ends of the shell optionally prevents or permits opening and closing of the container by alignment or offset of release means with respect to a sliding means. Pills or other units may be segregated in separate amounts or dosages within the container and dispensed in predetermined sequence from a plurality of rings of radially openable compartments forming a stack in which rows of compartments around the container axis can be rotated to sequentially register with the aperture means and compartments of each row sequentially opened.

31 Claims, 15 Drawing Figures

PUZZLE-LOCKING CONTAINER AND METHOD FOR STORING AND DISPENSING ARTICLES

BACKGROUND OF THE INVENTION

This invention relates to containers for convenient, compact storing and dispensing of medical pills or like small articles. The invention further concerns prevention of access to the stored articles by very young children through obscuring the mode by which the container may be opened. Dosages of various units of medicament on be segregated in the container according to a desired dispensing sequence so that inspection of the contents provides instant evidence of whether a particular dosage has been dispensed.

Pill cases and containers for storing and dispensing medicaments such as capsules and tablets are in wide use. Typical are the screw top or plug top bottles and tubes and the flat rectangular boxes or tins such as those commonly used for aspirin tablets. Recently, interest has focused on U.S. government emphasis that medicine containers embody means to prevent small children from gaining easy access to the contents and thus guard against accidental poisoning. Development of such containers has led to lids or tops that must be very strongly gripped, pressed, or otherwise manipulated in a manner generally beyond the strength or coordination of a yound child. However, some such containers have not been entirely satisfactory for they may be found too difficult to open even by adults, for example, by various handicapped persons and those unable to apply the necessary force or dexterity.

There has also been a need for simplified structure providing for compact storage of a large number of dosages of medicaments segregated according to a preset sequence or number of units for easy viewing and sequential dispensing over an extended period, e.g., a week's time. For example, a physician may prescribe a regimen in which units of one or a plurality of different medicines in pill, tablet or like form are to be taken in dosages of different combinations or at different times throughout the day and according to regularly repeating or varying numbers of units. Storing and handling of the different medicines, selecting the required medicines and the number of units to be taken each time, and then remembering whether a given dosage has been taken can be very burdensome.

Several approaches to providing lockable containers, compact storage and other features are disclosed in the U.S Pat. Nos. 3,537,422 and 3,618,559 to Moe; 3,570,707 to Finkel; 3,095,085 to Meijer; and 3,162,301 to Cage, Jr. These patents, however, do not provide the advantages and flexibility of the herein disclosed structure so as to meet the needs indicated above.

SUMMARY OF THE INVENTION

The structures and method of the present invention provide useful solutions to the problems set forth above, e.g. obstructing access to pill (or other) container contents by small children while providing easy access for adults, including many not able to apply much force or gripping power. The concepts herein further provide convenient and highly compact storage and segregation of pill dosages by which an extended regimen of the same or varying medication can be organized and segregated in a cannular container and handily dispensed according to a variably predetermined sequence. Instant visual verification can be made of the presence or absence in the container of any dosage of the regimen.

In accordance with the invention medical pills, tablets or the like can be compactly stored in an elongated tubular or cannular container according to desired dispensing sequences and the contents secured against access by very young children, by providing dispensing aperture means through the container side wall, closure means therefor and puzzle type lock or locking means comprising sliding or slider means which optionally can be blocked from sliding by the lock means to prevent opening of the container or released by movement of the lock means to slide so the dispensing aperture means can be uncovered. Advantageously, the dispensing aperture means is provided to open along substantially the full length of the container shell. According to the invention the lock means includes stop or retaining means movable into the path of the slider means so as to block it from sliding when the container is closed or to release it for sliding when moved out of the slider path or from engagement with the slider. One or more portions of the locking means advantageously may be provided at both ends of the container shell.

The lock means beneficially can comprise one or more fully or partially rotational means, which can be one or more rotating discs or plate-like means or portions thereof. Such construction can provide the lock means with stop means in the form of flanges for blocking the slider means so as to prevent container opening, and to provide releasing means, such as one or more notch means, to provide an opening or pathway through which the slider means can pass when it is desired to unlock and open the container. Beneficially such notch or passage means may be provided by flanges spaced along edge portions of the discs which can be moved concentrically about the container axis either individually or together. A portion of one disc can thus be adapted to cover a notch or release means in another of the discs so as substantially to obscure or camoflage it. Alignment of the necessary notches of all the discs or positioning the flanges so as not to block the slider means provides the key for the latter to be moved so as to effect or permit opening of the container. Such positioning has been found not readily apparent to nor accomplishable by a young child and thus effective to prevent such a child from opening the container and releasing its contents.

By arrangement of rows of radially directed compartments around the axis of the container so as to be in a rotatable cylindrical stack of rings of compartments the length thereof, the stack can be revolved within the shell to bring successive rows of compartments beneath the dispensing aperture means. Each compartment of a row can then be sequentially opened as a result of progressively greater sliding of the slider means which effects or permits opening of the aperture means.

From attention to embodiments below it will be seen that opening of containers of this invention may be accomplished through the key of rotating a retaining and releasing means or lock (or portion of it) that normally obstructs a slider means so as to place a notch means in registry therewith. The slideable means can then be slid or released through the notch means to allow or effect container opening. Where the slidable means serves as the cover or closure means for the dispensing aperture means sliding of the cover means acts to block or unblock the aperture means. An open empty container can be filled and then secured in locked closed position in converse manner.

BRIEF DESCRIPTION OF THE DRAWINGS

The above and further objects and advantages of the inventive concepts provided for hereby will become more apparent by attention to the following drawings and description of preferred embodiments given by way of example only, and not as limitative thereof and in which.

DESCRIPTION OF THE PREFERRED EMBODIMENTS

Figure 1:
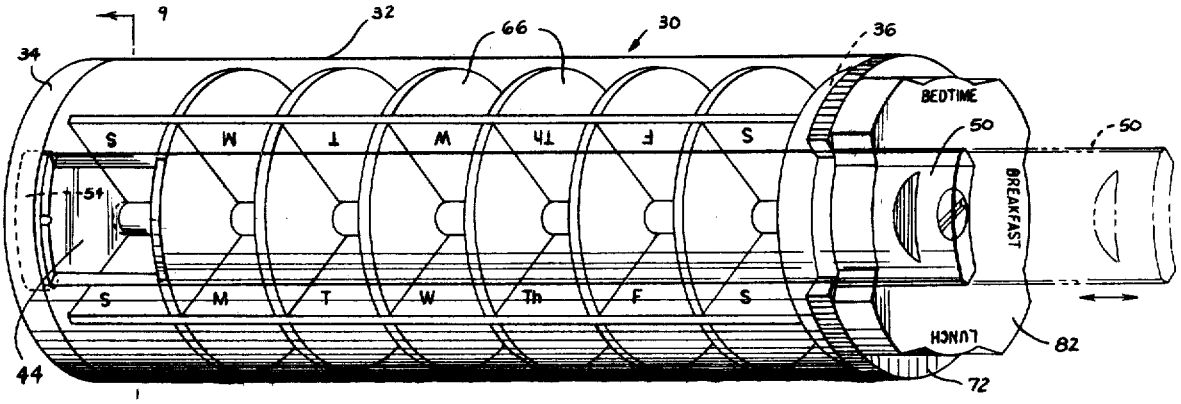
FIG. 1 is a perspective view of a puzzle-lockable container of this invention showing the dispensing aperture means partly opened and its slider type closure means extended through aligned notches in the locking discs at one end of the container.
Figure 2:
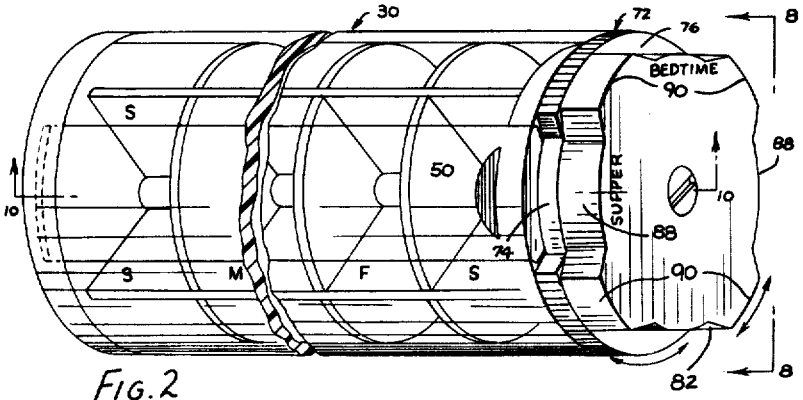
FIG. 2 is a perspective view of the container of FIG. 1 showing the cover of closure means when fully closed and the container in unlocked condition.
Figure 3:
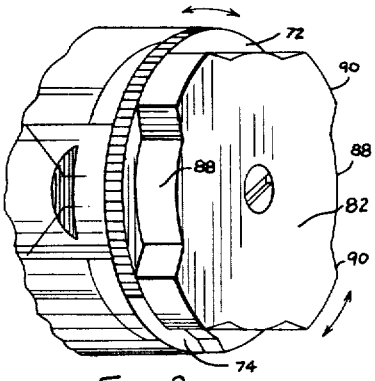
FIG. 3 is a perspective view of the locking end of the container of FIG. 2 showing the inner of the two lock discs rotated to block the closure means thus locking the container closed.

Referring to the drawings, a preferred embodiment of the container of this invention is depicted in FIGS. 1 through 11. Thus, the container 30 has its exterior wall or shell 32, preferably of transparent plastic, formed as an elongated hollow cylindrical or cannular tube. The shell is closed at its left or distal end by left end piece 34 and at its right or near end by right end piece 36. The shell is interrupted through one side of the wall area by a dispensing aperture means or opening 44 defined by spaced apart free edges 38 and 40 and terminating at the end pieces 34 and 36 thus extending the full length of the side wall. Recessed into the full length of each of the free edges are opposed grooves 46 and 48 which in tongue and groove fashion are contoured to slidably receive mating opposite side edges of a strip-like slideable means or slider 50. As can be seen, the slider has a slight circumferential camber matching the curvature of the shell 32 and serves as the closure means or cover for the container dispensing aperture 44.

To provide secure closure the distal end piece 34 spans the full diameter of the shell 32 outer dimension but is recessed or undercut at 54 to receive a tongue-like extension 56 of the distal end of the slider. The extension is radially inward of the outer surface of the main portion of the slider thus matching undercut 54. A nib 58 on the underside of tongue 56 provides friction holding of the sliding cover 50 when it is fully closed over the aperture means with extension 56 seated in undercut 54.

Figure 4:
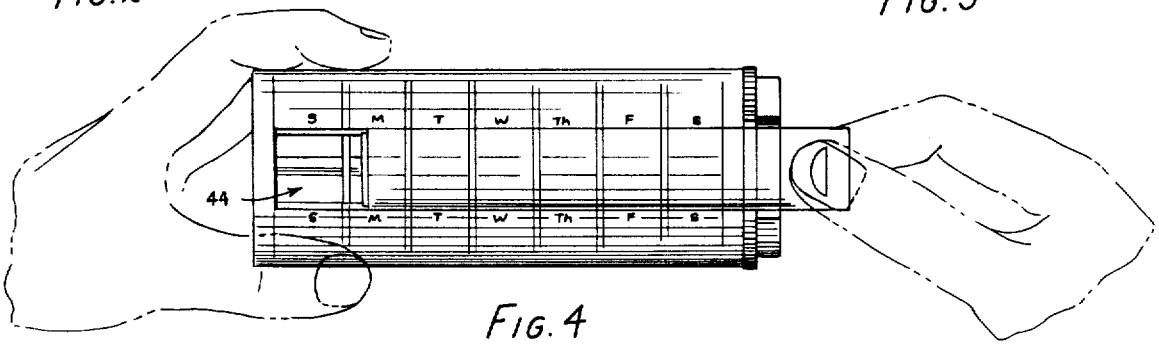
FIG. 4 is a plan view of the container of FIG. 1 showing how the slider cover means is manipulated.
Figure 5:
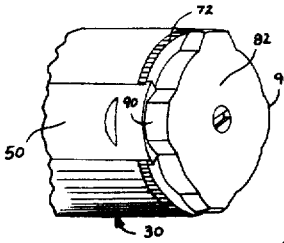
FIG. 5 is a perspective view, similar to FIG. 3, of the locking end of the container of FIG. 1 and showing a stop flange on the outer lock disc blocking sliding of the cover means thus preventing opening of the container.
Figure 10:
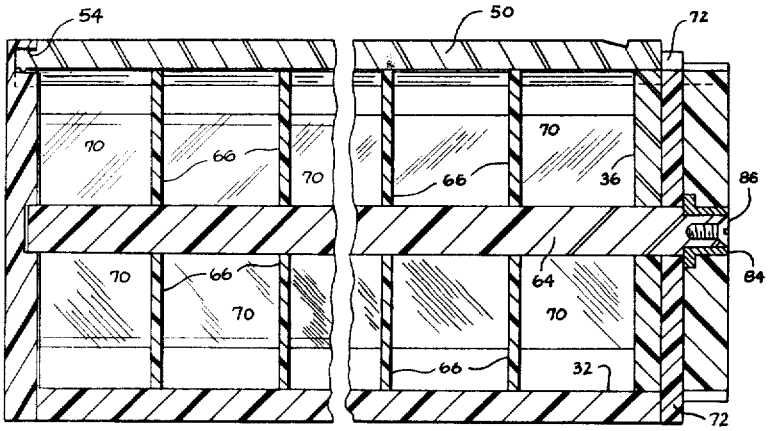
FIG. 10 is a cross-sectional view taken along line 10—10 of FIG. 2 rotated 90° clockwise.
Figure 9:
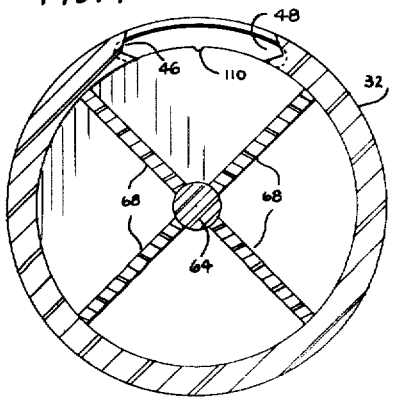
FIG. 9 is a cross-sectional view taken along line 9—9 of FIG. 1 rotated 90° clockwise.

At the proximate or right hand end of the container the end piece 36 is seen to fit within the inner diameter of the shell thus allowing slider 50, which has the same thickness as the shell side wall, to pass over it when the cover or slider 50 is withdrawn to open the container (see esp. FIGS. 1, 4, and 10). The end piece and shell together define the aperture end opening 60.

Positioned within the container is a rotor 62 having an axle 64 which is journaled at its opposite ends in the end pieces 34 and 36 and turnable about its central axis. Mounted on the rotor axle, at evenly spaced intervals along its length are a series of six disc-like transverse partitions 66. Also, extending radially out from the axle along its length are four equally spaced apart longitudinal vanes 68. The vanes, being spaced at right angles one from the other form the rotor into four radial quadrants along its length. The rotor and thereby the container are thus provided with separators or space divider means which form a stack of rings of segment shaped compartments 70 which can be rotated or turned together within the container shell about the rotor axis. (See FIGS. 1, 7, 9, and 10).

At the right end of the container the axle 64 extends through end piece 36. Mounted on the axle by loose frictional fit is a flat substantially round locking plate or disc 72. This disc is very slightly greater in diameter than the container shell and a portion of its periphery or flange for a distance slightly greater than the width of slider 50 is cut away to provide a gap or notch 74 as a passage through which the cover means slider can just pass. (See FIGS. 1, 4, and 7). The unnotched portion of the disc periphery forms a flange 76 that can be rotated as a stop means over the near end of the dispensing aperture means so as to block slider 50 from sliding action when it is in the fully closed position. The circumferential surface of the blocking disc is provided with serrations 78 to provide easy manipulation or turning. (See FIGS. 2 and 3)

Also positioned at the near end of the container is a flat plate or rotor turning disc 82 fixed to the near end of axle 64 by a grommet 84 and screw 86 which is counter sunk into the end of the axle (See FIGS. 1, 2, 7, and 10). The periphery or flange of the turning disc is notched or cut out at four places to form gaps or passages 88 therein separating four radially extending flange-like fingers or stop means 90 thereon. Each of the passages is large enough to just permit sliding therethrough of the slider 50 for opening of the dispensing aperture means 44. (See FIGS. 1, 2, and 7). By hand rotating of the dial or turning disc 82 one of the ear-like stop means 90 is engageable over the end of the slider to block it from sliding thus blocking closed the aperture and the rotor 62 is revolved within shell 32 which permits each of the lines 94 of compartments 80 to be successively turned to register with the dispensing aperture 44 which occurs on aligning one of the notches 88 with the slider end or the opening 60. When screw 86 is sufficiently tightened, mere rotating of the rotor by turning disc 72 will cause the locking disc 72 to be carried around with the turning disc 82, the two discs remaining in the same relative positions one to the other. So adjusted, by manually holding one of the discs the other independently can be rotated relative thereto so their relative rotational positions can be altered to either align notch 74 and any of the passages 88 with the near end of slider 50 or to place them each out of alignment with the other which effectively locks the container closed by preventing slider 50 from sliding through both notch 74 and one of the passages 88 until the necessary alignment of the notch and a passage is perceived and accomplished after which the slider can be slid axially of the container to open it.

Figure 12:
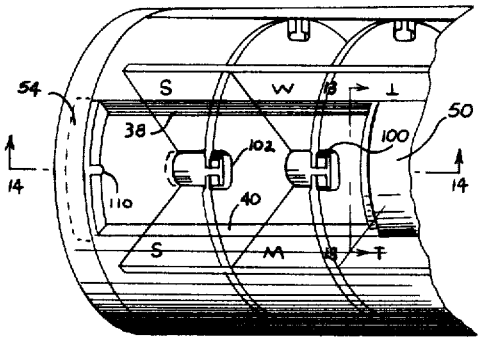
FIG. 12 is a partial perspective view of another embodiment of the container showing friction gate means in the compartment walls for controlling incremental sliding of the cover means.
Figure 13:
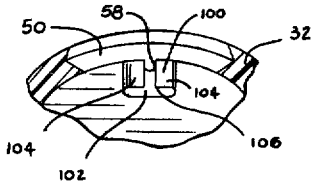
FIG. 13 is a cross-sectional view taken along line 13—13 looking in the direction of the arrows and showing the lug on the closure means for friction engagement with the friction gate means.
Figure 14:
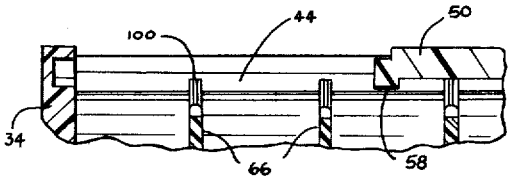
FIG. 14 is a cross-sectional view of the embodiment of FIG. 12 taken along line 14—14 looking in the direction of the arrows.

As indicated in FIGS. 12, 13 and 14 each of the plates 66 can have in its outer periphery a thinned area 100 centered midway between the vanes 68 in each quadrant or line 94. A "T" shaped slot 102 is cut out of each thinned area to form a pair of opposed stiffly resilient flaps 104 defining a narrow slit 106 or opening between their confronting free edges. In this embodiment stop means on the distal end of the slider 50 is provided by the short lug or nib 58 made the same width as the slit or a very slightly greater width so as to make a frictional fit therein. As the slider is moved axially the nib acts in the T-shaped slot as a positive stop or catch means giving the slider a positive stopping or positioning action as the nib engages the edges of the slit and slightly moves them axially of the container in hinged gate-like manner. The slider is thus settable at a plurality of fixed locations to hold each compartment 70 open for dispensing as desired as the lug is frictionally held in any desired one of the aligned slits 106. There is also a small depression 110 centered in the bottom of the recess 54 and available to receive the nib 58 and frictionally aids in holding the slider in the closed position when the disc 72 is not engaged over the proximate end of the slider.

Suitable indicia to indicate, for example, typical medicine taking periods or times such as noon or lunchtime, breakfast, supper or 6 pm., and bedtime or 10 pm. can be affixed to the dial or disc 82 to denote the appropriate passage 88 which should be coincided with the end of the apperture means 44 in order to show how to turn the rotor to position the compartment 70 of interest opposite the aperture means for dispensing its contents.

Figure 6:
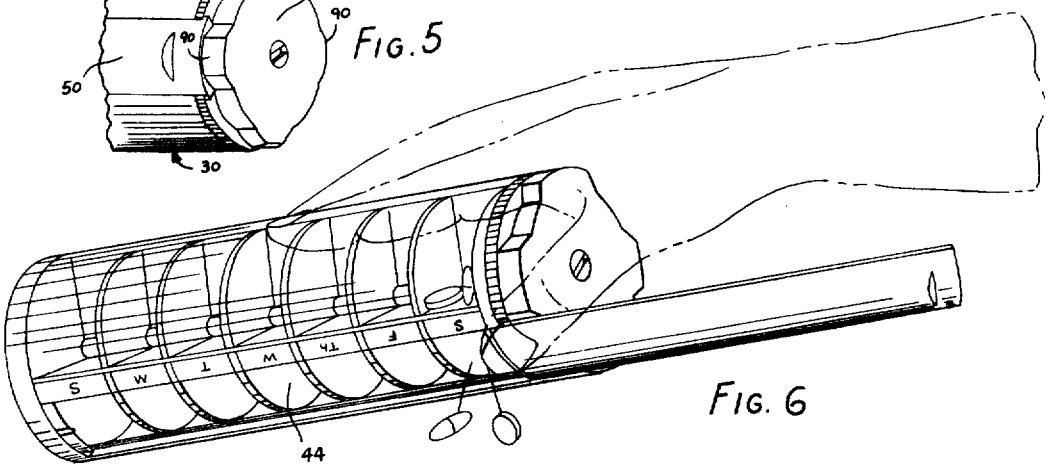
FIG. 6 is a perspective view showing the slide closure means extended to fully open the dispensing aperture and the container inverted to dispense a two unit dosage.
Figure 7:
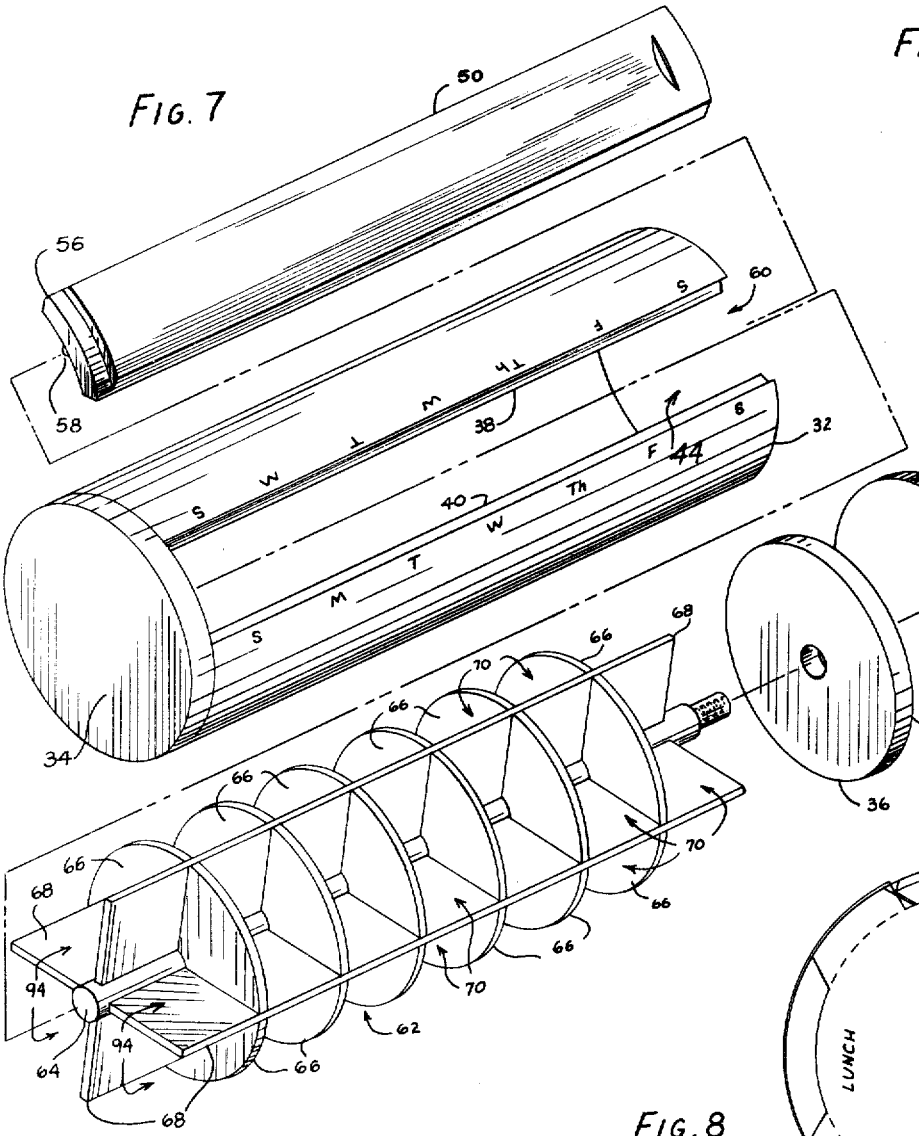
FIG. 7 is an exploded perspective view of the container of FIG. 1 showing how the parts are interfitted.
Figure 11:
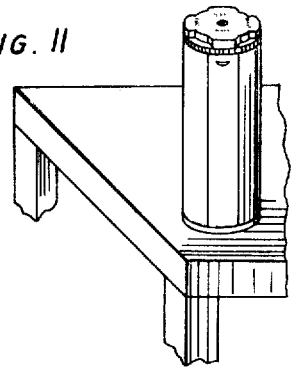
FIG. 11 shows the cannular container on end on a table, illustrating its compact storage and handy convenience.
Figure 11:
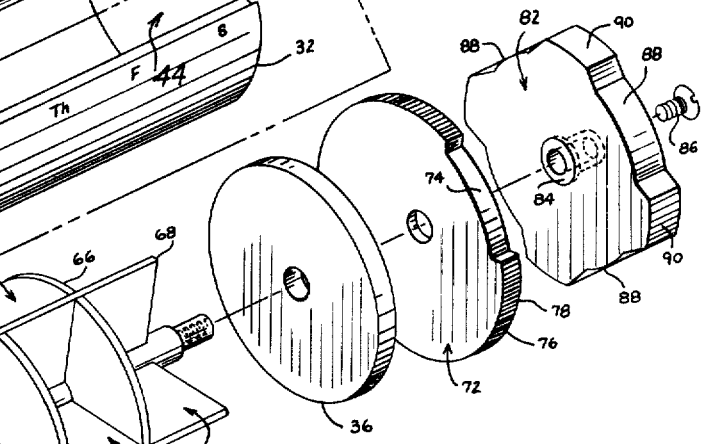
Figure 8:
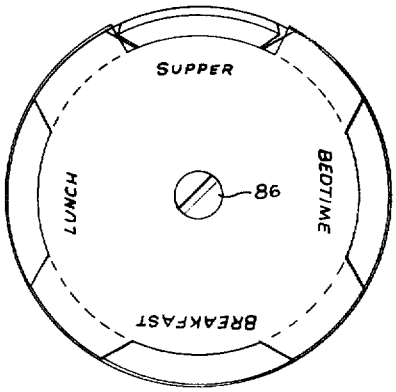
FIG. 8 is an end view of the container taken in the direction of the arrows 8—8 of FIG. 2 rotated 90° clockwise.

With one or more compartments opened as shown, for example, in FIGS. 1 or 6, dispensing is accomplished by inverting the compartment to allow the contents to drop out or the contents may be removed manually.

Figure 15:
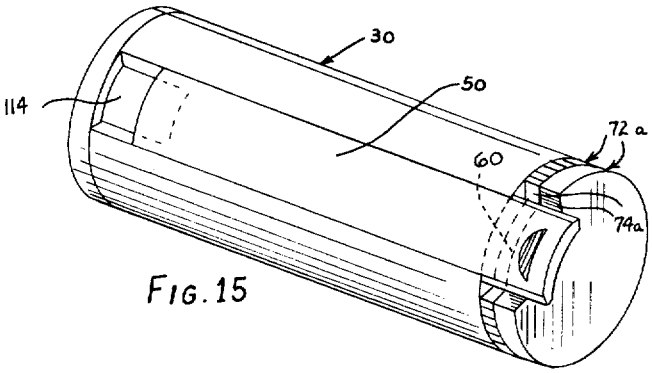
FIG. 15 is a perspective view of another embodiment of the container but having a short dispensing aperture.

In FIG. 15 there is shown another embodiment of a container 30 Of this invention which dispenses with the rotor and compartments. It has a shortened apperture means 114 which is opened or locked closed by a pair of closely similar locking plates or discs 72*a*. In this embodiment the outer disc may or may not be serrated around its gripping edge. It will be apparent that registry of the notches 74*a* of these discs and with the end of the slider allows the latter to be slid axially to open the container. With the slider blocking the apperture means the two notches can be placed out of register and as in the preceding embodiment mere turning of the one or the other will tend to rotate them together so as to prevent opening the container until the three units (notches and slider end) are congruent with the end opening 60.

It will be appreciated that when one of the fingers 90 or flanges 72 or 72*a* are positioned over the aperture end opening 60 or both rotated so as to be out of registry with the end opening and the proximate end of slider 50, there is a puzzle, that is, it is not immediately or readily apparent as to how to open the container, the mode of opening being thus obscured. This is even more a puzzle when one of the notches (e.g. 74, 74*a*, 88) is turned to a position diametrally opposite the end of the slider. The container is thus resistant to opening by very small children who may be unable to determine the proper positioning of the parts and how to accomplish it to effect opening.

Where two or more discs are employed as the locking or retaining and releasing means, and it will be understood that one or more of the discs can be at opposite ends of the container, the discs can be rotated independently or together so any one of them is sufficient to retain the cover means in place but when the proper notch means in each disc are aligned with the slider end the cover means can be moved therethrough for opening of the aperture means. If desired disc 72 can have notches of different sizes only one, for example being wide enough, or alternatively deep enough, or both, to allow the slider to pass therethrough for added puzzlement as to the correct matching of notches to slider end. Subtle indicia, e.g., an ink dot or slight coloration, can be applied to the correct notch or passage to identify them unobtrusively.

It will be appreciated that with the cylindrical construction of the case or shell and the rotating compartments therein, a single narrow dispensing aperture and cover means thereover, provide for dispensing through the full opening width of all compartments in the container.

Various changes and additions can be made, all within the scope of the appended claims.

I claim:

1. A cannular article storing and dispensing container having means for preventing access to the container contents by very young children through obscuring the mode of opening it comprising:

A. an elongated tubular shell having closed opposite ends and aperture means opening through the shell side wall for loading of articles into the container and dispensing them therethrough;

B. closure means adapted to cover said aperture means, said closure means comprising slider means slideable axially of said container shell;

C. locking means operative at least at one end of said shell for preventing or permitting movement of said slideable means so as to permit the closure means to block the aperture means closed when said slideable means is prevented from sliding or to permit opening of the aperture means when said slideable means is released for sliding action; and D. said locking means comprises flange means turnable circumferentially about the longitudinal axis of said tubular shell around substantially the entire perimeter thereof.

2. The container of claim 1 in which said locking flange means extends very slightly radially of said tubular shell about the full circumference thereof.

3. The container of claim 1 in which said flange means has a portion moveable into and out of the path of said slider means and said flange means has notch means associated therewith adapted to permit said slider means to be moved therethrough whereby circumferential turning of said flange means optionally blocks said slider means in the closed position covering said aperture means or aligns said notch means with an end of the slider means for uncovering the aperture means by movement of the slider means through said notch means.

4. The container of claim 1 in which said flange means are a plurality of flanges each having an associated notch means alignable one with the other whereby notch means associated with one of said flanges when aligned with notch means of another of said flanges permit a container opening movement of said slider means.

5. The container of claim 1 in which said flange means are a plurality of flanges each capable of being turned independently of the other.

6. The container of claim 5 in which one of said flange means substantially obscures the other from view except for an outer edge portion thereof.

7. A cannular article storing and dispensing container having means for preventing access to the container contents by very young children through obscuring the mode of opening it comprising:

A. an elongated tubular shell having closed opposite ends and
aperture means opening through the shell side wall for loading of articles into the container and dispensing them therethrough;

B. closure means adapted to cover said aperture means, said closure means comprising slider means slideable axially of said container shell; and C. locking means comprising at least one disc means operative at least at one end of said shell for preventing or permitting movement of said slideable means so as to permit the closure means to block the aperture means closed when said slideable means is prevented from sliding or to permit opening of the aperture means when said slideable means is released for sliding action.

8. The container of claim 7 in which said disc means has a plurality of radially extending ears positionable into the path of movement of said slideable closure means so as to prevent the sliding thereof.

9. The container of claim 7 in which said disc means is rotatable on the container axis.

10. The container of claim 7 in which said at least one disc means comprises two such disc means.

11. The container of claim 10 in which one of said disc means at least partially obscures the other from view, an outer edge portion of said other disc means remaining visible.

12. The container of claim 7 in which said disc means has passage means positioned in an edge portion thereof for movement therethrough of said slider means to effect opening of said container aperture means.

13. The container of claim 10 in which each said disc means has passage means therein for permitting movement therein of said slider means, each disc being rotatable with respect to the other for placing passage means of one disc into or out of alignment with passage means in the other disc so as to prevent or permit opening of the aperture means by movement of the slider means in said passage means.

14. The container of claim 10 in which said disc means are frictionally associated such that rotation of one of said disc means causes said other disc means to be rotated therewith.

15. A cannular article storing and dispensing container having means for preventing access to the container contents by very yound children through obscuring the mode of opening it comprising:

A. an elongated tubular shell having closed opposite ends and
aperture means opening through the shell side wall for loading of articles into the container and dispensing them therethrough;

B. closure means adapted to cover said aperture means, said closure means comprising slider means slideable axially of said container shell; and C. locking means rotatable on the container axis and operative at least at one end of said shell for preventing or permitting movement of said slideable means so as to permit the closure means to block the aperture means closed when said slideable means is prevented from sliding or to permit opening of the aperture means when said slideable means is released for sliding action.

16. A cannular article storing and dispensing container having means for preventing access to the container contents by very young children through obscuring the mode of opening it comprising:

A. an elongated tubular shell having closed opposite ends and aperture means comprising an elongated slot opening through the shell side wall for loading of articles into the container and dispensing them therethrough;

B. closure means adapted to cover said aperture means, said closure means comprising slider means slideable axially of said container shell;

C. locking means operative at least at one end of said shell for preventing or permitting movement of said slideable means so as to permit the closure means to block the aperture means closed when said slideable means is prevented from sliding or to permit opening of the aperture means when said slideable means is released for sliding action;

D. said slider means formed as an elongated strip substantially the length of the container shell and slideable in said slot for opening and closing said dispensing aperture means;

E. rotor means forming compartments for rotation in said shell; and

F. at least a portion of said locking means operatively connected thereto and adapted to be manipulated to rotate said rotor means within the shell for positioning selected ones of said compartments at said dispensing aperture means.

17. The container of claim 16 in which said compartments are formed by divider means comprising transverse partitions and longitudinal vanes.

18. The container of claim 16 in which said locking means comprises a plurality of radially extending ear means on said rotor manipulating means and moveable into the slide path of said slider means.

19. The container of claim 16 in which said rotor manipulating means comprises dial means positioned at one of said container ends and turnable about the longitudinal axis of said container.

20. The dispensing container of claim 19 in which said dial has notch means in the edge portion thereof for permitting said slider means to pass therethrough.

21. The container of claim 19 in which said dial has indicia for indicating a desired position of said rotor in the container.

22. The container of claim 17 in which catch means comprising cooperative catch elements are provided for releasably holding said closure means at various positions of opening and closure and wherein at least one of said catch elements is positioned in at least one of said transverse partitions.

23. The container of claim 22 in which one of said catch elements is a narrow gap in an outer edge portion of one of said partitions and the other catch element is a detent lug positioned on said slider means.

24. The container of claim 23 in which said narrow gap is defined between a pair of opposed hinge-like flaps in said partition edge.

25. A cannular article storing and dispensing container having means for preventing access to the container contents by very young children through obscuring the mode of opening it comprising:

A. an elongated tubular shell having closed opposite ends and aperture means opening through the shell side wall for loading of articles into the container and dispensing them therethrough;

B. closure means adapted to cover said aperture means, said closure means comprising slider means slideable axially of said container shell; and C. rotatable locking means operative at least at one end of said shell for preventing or permitting movement of said slideable means so as to permit the closure means to block the aperture means closed when said slideable means is prevented from sliding or to permit opening of the aperture means when said slideable means is released for sliding action; and D. said rotatable locking means has a portion engageable over the end of the slider means for retaining the aperture means closed and having at least one notch portion or passage means through which the slider can move for release thereof so that opening of the aperture means can be effected.

26. A cannular article storing and dispensing container having means for preventing access to the container contents by very young children through obscuring the mode of opening it comprising:

A. an elongated tubular shell having closed opposite ends and aperture means opening throuh the shell side wall for loading of articles into the container and dispensing them therethrough;

B. closure means adapted to cover said aperture means, said closure means comprising slider means slideable axially of said container shell; and C. rotatable locking means operative at least at one end of said shell for preventing or permitting movement of said slideable means so as to permit the closure means to block the aperture means closed when said slideable means is prevented from sliding or to permit opening of the aperture means when said slideable means is released for sliding action; and D. said locking means comprises at least two generally round disc means, each disc means having at least one passage means for passage therethrough of said slider means and each disc means having at least one flange portion for blocking the passage of said slider means from opening said aperture means, the disc means being moveable independently one with respect to another.

27. The container of claim 26 in which one of said disc means has a greater number of said passages than another of said disc means.

28. A cannular article storing and dispensing container having means for preventing access to the container contents by very young children through obscuring the mode of opening it comprising:

A. an elongated tubular shell having closed opposite ends and aperture means opening through the shell side wall for loading of articles into the container and dispensing them therethrough;

B. closure means adapted to cover said aperture means, said closure means comprising slider means slideable axially of said container shell; and C. rotatable locking means operative at least at one end of said shell for preventing or permitting movement of said slideable means so as to permit the closure means to block the aperture means closed when said slideable means is prevented from sliding or to permit opening of the aperture means when said slideable means is released for sliding action; and D. said locking means comprises two generally flat plates each mounted at an end of said cylindrical shell for independent rotation about its longitudinal axis, each said plate having a notched edge portion so that a notch in one plate is manually alignable with a notch in the other plate to allow said slideable closure means to be moved in said notches between positions adapted to permit the opening and closing of said dispensing aperture means whereby when said closure means is in the closed position any significant misalignment of the said notches blocks an opening movement of said closure means so as effectively to lock said closure means in its closed position covering said dispensing aperture means.

29. A cannular article storing and dispensing container having means for preventing access to the container contents by very young children through obscuring the mode of opening it comprising:

A. an elongated tubular shell having closed opposite ends and aperture means opening through the shell side wall for loading of articles into the container and dispensing them therethrough;

B. closure means adapted to cover said aperture means, said closure means comprising slider means slideable axially of said container shell;

C. locking means having a portion moveable in a direction along the shell circumference at a position axially beyond and operative at least at one end of said shell for preventing or permitting movement of at least a portion of said slideable means axially beyond an end of the shell so as to permit the closure means to block the aperture means closed when said slideable means is prevented from sliding or to permit opening of the aperture means when said slideable means is released for sliding action; and D. catch means for releaseably holding said closure means at a plurality of progressively open or closed positions with respect to said dispensing aperture means.

30. A cannular article storing and dispensing container having means for preventing access to the container contents by very young children through obscuring the mode of opening it comprising:

A. an elongated tubular shell having closed opposite ends and aperture means opening through the shell side wall for loading of articles into the container and dispensing them therethrough;

B. closure means adapted to cover said aperture means, said closure means comprising slider means slideable axially of said container shell;

C. locking means having a portion moveable in a direction along the shell circumference at a position axially beyond and operative at least at one end of said shell for preventing or permitting movement of at least a portion of said slideable means axially beyond an end of the shell so as to permit the closure means to block the aperture means closed when said slideable means is prevented from sliding or to permit opening of the aperture means when said slideable means is released for sliding action;

D. said locking means having passage means therein for permitting said slider means to pass therethrough for opening of said dispensing aperture means.

31. A cannular article storing and dispensing container having means for preventing access to the container contents by very young children through obscuring the mode of opening it comprising:

A. an elongated tubular shell having closed opposite ends and aperture means opening through the shell side wall for loading of articles into the container and dispensing them therethrough;

B. closure means adapted to cover said aperture means, said closure means comprising slider means slideable axially of said container shell;

C. locking means having a portion moveable in a direction along the shell circumference at a position axially beyond and operative at least at one end of said shell for preventing or permitting movement of at least a portion of said slideable means axially beyond an end of the shell so as to permit the closure means to block the aperture means closed when said slideable means is prevented from sliding or to permit opening of the aperture means when said slideable means is released for sliding action; and D. a plurality of article storing compartments provided in the container, and means for positioning selected ones of said compartments adjacent said aperture means for dispensing of articles only from said selected compartments when the aperture means is opened.

* * * * *